United States Patent [19]

Ishimoto

[11] Patent Number: 4,878,876

[45] Date of Patent: Nov. 7, 1989

[54] APPARATUS FOR CHANGING THE RUNNING TRACK OF A RACING TOY

[75] Inventor: Zenichi Ishimoto, Tokyo, Japan

[73] Assignee: Nikko Co., Ltd., Tokyo, Japan

[21] Appl. No.: 221,466

[22] Filed: Jul. 19, 1988

[30] Foreign Application Priority Data

Sep. 12, 1987 [JP] Japan ..... 62-227560

[51] Int. Cl.[4] ..... A63H 18/00; A63H 30/02; A63H 33/26

[52] U.S. Cl. ..... 446/446; 446/455; 446/129

[58] Field of Search ..... 446/446, 454, 455, 456, 446/486, 460, 462, 468, 465, 431, 437, 484, 485, 130, 129, 133–136, 139

[56] References Cited

U.S. PATENT DOCUMENTS

| | | | |
|---|---|---|---|
| 3,569,969 | 3/1971 | Lemon | 446/456 X |
| 3,586,328 | 6/1971 | Kazel | 446/446 X |
| 4,163,341 | 8/1979 | Jones et al. | 446/468 X |
| 4,221,077 | 9/1980 | von Winckelmann | 446/460 X |
| 4,471,566 | 9/1984 | Ishimoto | 446/460 X |
| 4,571,213 | 2/1986 | Ishimoto | 446/456 X |

FOREIGN PATENT DOCUMENTS

| | | | |
|---|---|---|---|
| 878316 | 6/1953 | Fed. Rep. of Germany | 446/446 |
| 2012271 | 3/1970 | Fed. Rep. of Germany | 446/446 |
| 1581242 | 12/1980 | United Kingdom | 446/456 |

*Primary Examiner*—Robert A. Hafer
*Assistant Examiner*—D. Neal Muir
*Attorney, Agent, or Firm*—Young & Thompson

[57] ABSTRACT

An apparatus for changing the running track of a toy car racer in a racing toy, in which a motor-driven running body runs on a base having a plurality of guide tracks in parallel. The body has a guide element engageable with the guide track and the running body is provided with an electromagnetic coil for engaging and disengaging the guide element with the guide track. The electromagnetic coil at its pole portions is provided with yokes each energizable to a different polarity and protruding in parallel to a predetermined direction to form a pair of magnetic pole portions, opposite to which are swingably arranged linkage for controlling wheel-steerage, including a magnet at its middle portion adjacent to the magnetic pole portions.

3 Claims, 3 Drawing Sheets

APPARATUS FOR CHANGING THE RUNNING TRACK OF A RACING TOY

FIELD OF THE INVENTION

This invention relates to an apparatus for changing the running track of a racing toy on a running base provided with guide tracks.

BACKGROUND OF THE INVENTION

There has conventionally been known a racing toy which includes a single running base provided thereon with a plurality of endless guide tracks in parallel spaced apart at a predetermined distance from each other, on which one or more running bodies may run simultaneously. The running body for use in such type of the racing toy is generally known to have a driving motor and a circuit for controlling the motor-drive. As a power-supplying system therefor, there has been known an electric path extended along the guide track on the base or a radio-controllable system containing a secondary battery.

In the conventional racing toy of such type, however, the power-supplying system of the electric path along the guide track does not allow the change of a running direction or the steering control independently for the running body to transfer the tog from one track to another adjacent track. On the other hand, the power-supplying system containing the secondary battery may utilize the radio-controllable system for conducting not only the drive-control and stop-control but also the steering-control. In the latter case, however, utilization of a slot as the guide track for inserting a protruding guide pin of the running body into the slot makes the track-change impossible or extremely difficult with the radio-controllable system during the running phase.

Accordingly, an object of the invention is to provide an apparatus in a racing toy car, in which instructions from a controller of a radio-transmitter or the like may readily and conveniently perform the engagement and disengagement of the track with an engaging means of the toy car, as well as the steering-control thereby enabling an optional track-change at any time during the running phase.

SUMMARY OF THE INVENTION

In order to achieve the above object, the invention provides an apparatus in a racing toy for changing the running track of a racing toy car, in which a motor-driven running body runs on a base having a plurality of guide tracks in parallel, said body having a guide element engageable with said guide track, characterized in that the running body is provided with an electromagnetic coil for engaging and disengaging the guide element with the guide track, said electromagnetic coil at its pole portions being provided with yokes each energizable to a different polarity and protruding in parallel to a predetermined direction to form a pair of magnetic pole portions, opposite to which is swingably arranged linkage for controlling wheel-steerage, including a magnet at its middle portion adjacent to the magnetic pole portions.

In the apparatus according to the invention, the guide element engageable with the guide track is a guide pin which protrudes from a front end of a movable iron core supported with a spring at one end of the electromagnetic coil.

Furthermore, the electromagnetic coil is preferably energized to provide the opposite selected polarity by means of a radio-controllable system.

In the apparatus according to the invention, conducting lines are provided at both sides of the running base so as to transmit therethrough operational instructions to a pickup coil mounted on a motor-driven body running on the base.

In accordance with the invention, the engagement and disengagement of the guide element with the track on the base may be achieved by use of the controlling circuit utilizing the radio-controllable system for energizing the electromagnetic coil, while the magnetic polarity generated by the electromagnetic coil may control the wheel-steerage, thereby readily selecting a desired track and optionally changing the track during.

The invention will now be described in more detail as to its preferred embodiments with reference to the accompanying drawings.

PREFERRED EMBODIMENTS OF THE INVENTION

Figure 1:
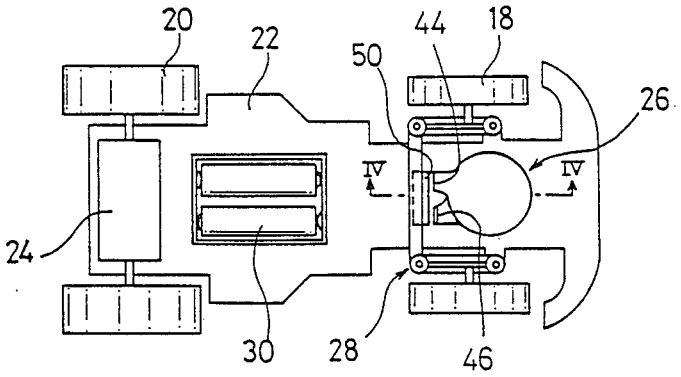
FIG. 1 is a schematic view of one embodiment of a running body of the racing toy useful in the apparatus according to the invention.
Figure 2:
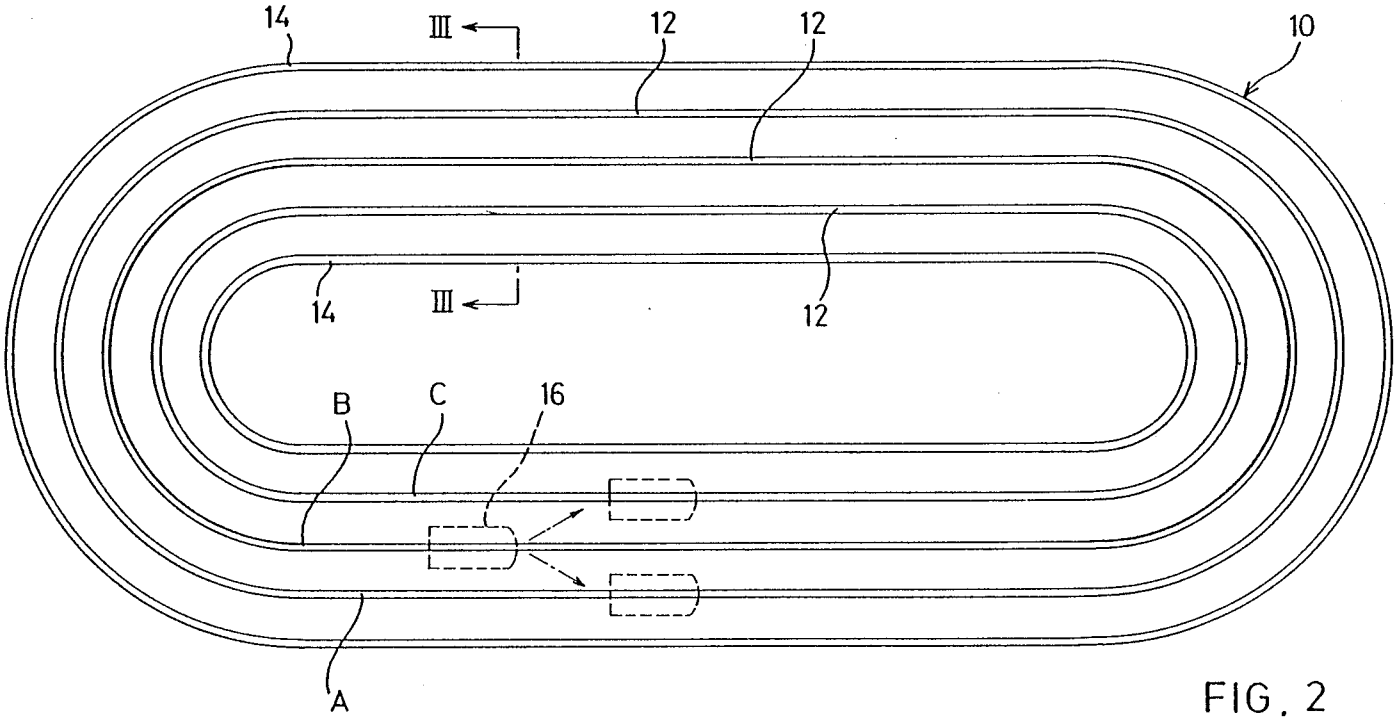
FIG. 2 is a plan view of the base for the running toy of FIG. 1.

FIG. 1 is a schematic view of one embodiment of the racing car useful in the apparatus according to the invention, while FIG. 2 is a plan view of the base for the running toy car of FIG. 1.

In FIG. 2, reference 10 represents a racing base which is provided thereon, as described hereinafter in detail, with a plurality of endless slots 12 in parallel spaced apart at a predetermined distance from each other. Further, the base 10 at its either edge is provided with side walls 14, 14 for preventing a running body from leaving the track (See FIG. 3).

The running toy 16 having the apparatus for changing the track according to the invention to be utilized for the racing base 10 includes a car body 22 having front and rear wheels 18 and 20, respectively, as shown in FIG. 1. Further, the car body 22 contains a motor 24 for driving the rear wheels 20, a track-changing mechanism 26, a steering-control mechanism 28 for steering front wheels 18, and a storage battery 30 for energizing the motor 24 and the track-changing mechanism 26. The running body 16 is provided with a control circuit (not shown in FIG. 1) for receiving operational instructions transmitted from a controller of a radio-transmitter or the like to effect the drive-control of the motor 24 and the operation-controls of the track-changing mechanism 26 and the steering-control mechanism 28. Connecting structures of the motor 24 to the rear wheels 20 and of the steering-control mechanism 28 to the front wheels 18 may be conventional in the art of the radio-controlled systems.

Figure 4:
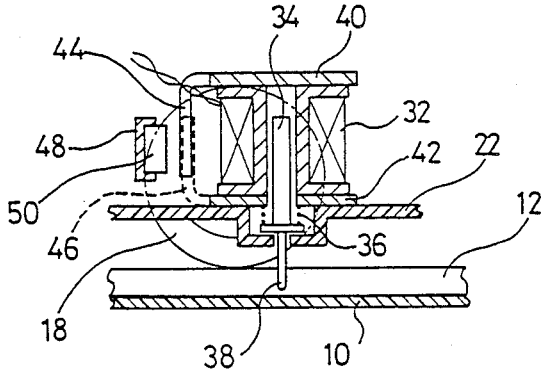
FIG. 4 is a sectional view of the running body taken along the line IV—IV of FIG. 1 for illustrating main portions of a transferring mechanism.
Figure 5:
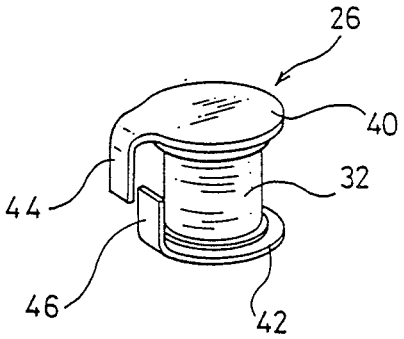
FIG. 5 is a perspective view of the transferring mechanism for actuating a steering control mechanism of the running body of FIG. 1.

According to this embodiment, the track-changing mechanism 26, as shown in FIG. 4, is provided with an electromagnetic coil 32 into a hollow space of which is inserted a movable iron core 34 which at its lower portion is urged downward by a spring 36 and at its lower end is connected to an axial guide pin 38. Further, the electromagnetic coil 32 at its upper and lower ends is provided with yokes 40, 42 which both extend in the same direction and then bend toward each other so as to provide a pair of parallel magnetic pole portions 44, 46 (See FIG. 5). Accordingly, the track-changing mechanism 26 thus constructed has magnetic pole portions 44, 46 of opposite polarity and attractively supports the movable iron core 34 to move upwardly the guide pin 38, depending on the energized state of the electromagnetic coil 32 or the direction of current flow.

The magnetic pole portions 44, 46 provided on the track-transferring mechanism 26 confront the central portion of a steering rod 48 of the steering-control mechanism 28 as well as confronting one of the pole faces of a magnet 50 mounted on the central portion of the steering rod 48. Such a construction enables the polarities generated in the magnetic pole portions 44, 46, to be determined depending on the energized state of the hereinbefore-described track-changing mechanism 26, while the magnet 50 is attracted to either of the magnetic pole portions 44, 46 and subsequently the steering rod 48 shifts to steering-control the front wheels 18. Simultaneously it makes possible to changing the track of the running body 16.

Figure 3:
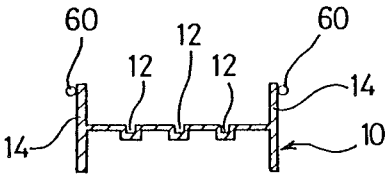
FIG. 3 is a sectional view of the base taken along the line III—III of FIG. 2.
Figure 6:
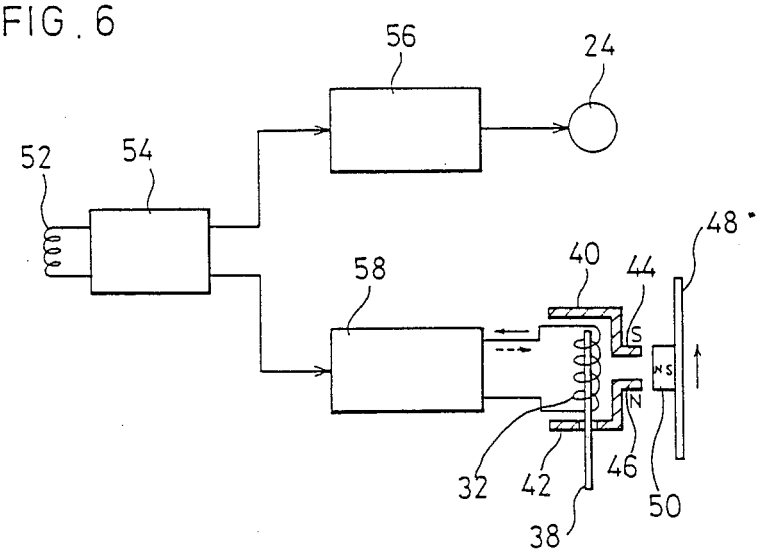
FIG. 6 is a circuit block diagram of a control circuit for driving or operating the running body of FIG. 1.
Figure 7:
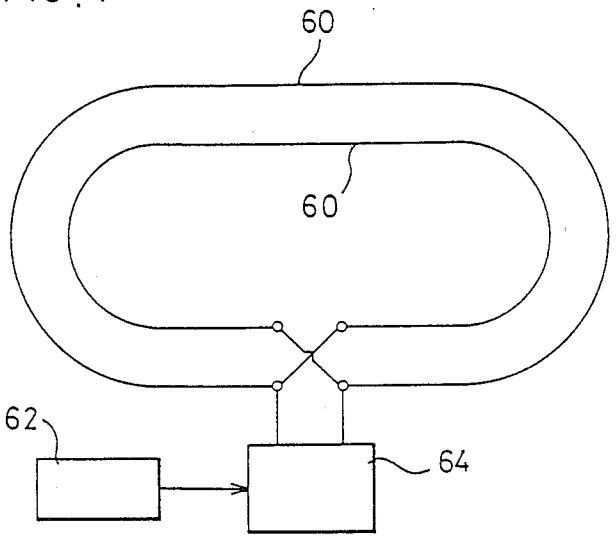
FIG. 7 is a circuit diagram of conducting lines for transmitting operational instructions to remote-control the running body.

FIGS. 6 and 7 show one embodiment of a controlling circuit for preferably operating a racing toy according to the invention. Namely, the running body 16 is provided with a receiving circuit 54 having a pick-up coil 52 for receiving operational instructions. The receiving circuit 54 receives a motor-drive control signal to control a motor-driving circuit 56 for driving the motor 24, thereby conducting a straight operation, a reversible operation or a stoppage of the rear wheels 20. Furthermore, an operational instruction for changing the track (and also serving as an operational instruction for controlling wheel-steerage) received in the receiving circuit 54 is transmitted to the track-changing circuit 58 to energize the electromagnetic coil 32 and to shift the steering rod 48 and the guide pin 38, thereby controlling the steerage of the front wheels 18 and changing the track the running body. In this case, in order to conveniently transmit operational instructions to the running body 16 on the racing base 10, along the outer faces of the side walls 14, 14 of the plastic racing base 10 as shown in FIG. 3 are provided conducting lines 60, to which operative instructions from the controller 62 are supplied, so that the running body 16, at any position on the racing base 10, may receive proper operational instructions through the pick-up coil 52.

The operation of the apparatus according to the invention will be described below.

Referring to FIG. 2, the running body 16 is now running along the B slot 12. At any time of this running phase, the controller 62 is operated to generate an instruction for reducing the rotation rate of the motor 24 and hence of the rear wheels 20. When the running body comes to a straight course of the B slot 12, the controller 62 is again operated to generate another instruction for energizing the electromagnetic coil 32. In this case, the electromagnetic coil 32 may be energized to determine the polarity of the magnetic pole portions 44, 46, so that the magnet 50 shifts in a fixed direction together with the steering rod 48, while the movable iron core 34 is attracted to the electromagnetic coil 32 against the force of the spring 36 and held in the hollow space thereby removing the guide pin 38 from the B slot 12. Consequently, the slowly running car body 16 is transferred from the B slot 12 toward the adjacent A or C slot 12. When the running body 16 has arrived at the intended position, the operational instruction from the controller 62 is then cancelled to allow the guide pin 38 to enter the new slot 12 under the action of the spring 36, thereby again achieving stable running operation.

It will be appreciated from the above embodiment that according to the invention the guide pin of the running body may be engaged and disengaged with the track by the electromagnetic coil, which is energized to change the magnetic polarity generated in the yokes, while a steering rod is provided with a permanent magnet for shifting to control steerage of wheels. Thus, a conventional radio-controlling system for the toy racer may be employed to achieve convenient and reliable track-change.

In particular, the apparatus according to the invention comprising a combination of an electromagnetic coil and a guide pin may conveniently employ a steering-control system by means of a conventional radio-controlling system without any special control circuit, thereby providing a very interesting racing toy with superior capability to change the running track at a low cost.

Furthermore, the apparatus in accordance with to the invention may be useful in not only the hereinbeforedescribed embodiment including a power battery in the running body, but also a racing toy provided with a power generating line along the track so as to conduct the drive-control of the running body by means of an outer power source.

Although the invention has been described hereinbefore in connection with its preferred embodiments, it will be appreciated that many variations and modifications may be made without departing from the spirit and scope of the invention.

What is claimed is:

1. Apparatus for changing the running track of a running toy car, in which a motor-driven running toy car body runs on a base having a plurality of parallel guide tracks, said body having a guide pin engageable in any selected one of said tracks, the running body having an electromagnetic coil for disengaging said guide pin from a said track and spring means to urge said guide pin into a said track, said electromagnetic coil having oppositely polarized yokes at opposite ends thereof, said yokes having protuberant portions comprising magnetic poles which are of opposite polarity when said coil is energized, said protuberant portions being disposed side by side of each other in one direction, steering linkage swingably connected with wheels of said running body to steer said running body, said linkage having a magnet thereon which is disposed adjacent said protuberant portions of said yokes and is movable parallel to said one direction, whereby energization of said coil simultaneously moves said guide pin out of one said track and moves said magnet and linkage to steer said running body into the path of another track, whereupon the deenergization of said coil permits said spring means to enter said pin into said another track.

2. Apparatus as claimed in claim 1, said linkage including a rod parallel to said one direction, said magnet being mounted at the center of the rod.

3. Apparatus as claimed in claim 1, and a radiocontrollable system for energizing said coil, said system including conducting lines at both sides of the base, and a pick-up coil mounted on the body for receiving radio signals from said lines.

* * * * *